US008624514B2

(12) United States Patent
Kang

(10) Patent No.: US 8,624,514 B2
(45) Date of Patent: Jan. 7, 2014

(54) FEED FORWARD IMBALANCE CORRECTOR CIRCUIT

(75) Inventor: Douglas Min Kang, San Jose, CA (US)

(73) Assignee: Power Integrations, Inc., San Jose, CA (US)

( * ) Notice: Subject to any disclaimer, the term of this patent is extended or adjusted under 35 U.S.C. 154(b) by 174 days.

(21) Appl. No.: 13/350,249

(22) Filed: Jan. 13, 2012

(65) Prior Publication Data

US 2013/0181624 A1 Jul. 18, 2013

(51) Int. Cl.
*H05B 37/02* (2006.01)

(52) U.S. Cl.
USPC ..... 315/200 R; 315/307

(58) Field of Classification Search
None
See application file for complete search history.

(56) References Cited

U.S. PATENT DOCUMENTS 5,969,481 A * 10/1999 Konopka ..... 315/209 R
7,132,802 B2 * 11/2006 Fischer et al. ..... 315/224
8,508,140 B2 * 8/2013 Leung et al. ..... 315/192
2011/0025217 A1 * 2/2011 Zhan et al. ..... 315/219
2012/0086350 A1 * 4/2012 Lin et al. ..... 315/200 R

OTHER PUBLICATIONS

Ang, "AN50: Feed Forward Compensation for ZXSC300 LED Driver," Zetex Semiconductors PLC, Issue 1—Oct. 2007 (6 pages).
"HVLED805: Off-Line LED Driver with Primary-Sensing," STMicroelectronics, Doc. ID 18077 Rev. 1, Oct. 2010 (29 pages).

* cited by examiner

*Primary Examiner* — Crystal L Hammond
(74) *Attorney, Agent, or Firm* — Blakely Sokoloff Taylor & Zafman LLP

(57) ABSTRACT

A circuit includes a first active device is coupled between a third terminal and a second terminal. The first active device has a control terminal coupled a first terminal to receive a signal representative of a rectified input voltage. A second active device is coupled between the control terminal of the first active device and the second terminal. The second active device has a control terminal coupled to a fourth terminal. The second active device is coupled to be controlled in response to a bypass voltage at the fourth terminal. The first active device is coupled to be controlled in response to the rectified input voltage and the bypass voltage.

25 Claims, 5 Drawing Sheets

FEED FORWARD IMBALANCE CORRECTOR CIRCUIT

BACKGROUND INFORMATION

1. Field of the Disclosure

The present invention relates generally to circuits that drive light emitting diodes (LEDs). More specifically, embodiments of the present invention are related to LED driver circuits that including triac dimming circuitry.

2. Background

Light emitting diode (LED) lighting become very popular in the industry due to the many advantages that this technology provides. For example, LED lamps have a longer lifespan, fewer hazards and increased visual appeal when compared to other lighting technologies, such as for example compact fluorescent lamp (CFL) or incandescent lighting technologies. The advantages provided by LED lighting have resulted in LEDs being incorporated into a variety of lighting technologies, televisions, monitors and other applications that may also require dimming.

One known technique that has been used for dimming is the use of a triac circuit for analog LED dimming or phase angle dimming. A triac circuit operates by delaying the beginning of each half-cycle of ac power, which is known as "phase control." By delaying the beginning of each half-cycle, the amount of power delivered to the lamp is reduced and the light output of the LED appears dimmed to the human eye. In most applications, the delay in the beginning of each half-cycle is not noticeable to the human eye because the variations in the phase controlled line voltage and the variations of power delivered to the lamp occur so quickly. Although triac dimming circuits work especially well when used to dim incandescent light bulbs since the variations in phase angle with altered ac line voltages are immaterial to incandescent light bulbs, flicker may be noticed when triac circuits are used for dimming LED lamps.

LED lamps are typically driven with LED drivers having a regulated power supplies, which provide regulated current and voltage to the LED lamps from ac power lines. Unless the regulated power supplies that drive the LED lamps are specially designed to recognize and respond to the voltage signals from triac dimming circuits in a desirable way, the triac dimming circuits are likely to produce non-ideal results, such as flickering, blinking and/or color shifting in the LED lamps.

A difficulty in using triac dimming circuits with LED lamps comes from a characteristic of the triac itself. Specifically, a triac is a semiconductor component that behaves as a controlled ac switch. Thus, the triac behaves as an open switch to an ac voltage until it receives a trigger signal at a control terminal, which causes the switch to close. The switch remains closed as long as the current through the switch is above a value referred to as the holding current. Most incandescent lamps easily draw more than the minimum holding current from the ac power source to enable reliable and consistent operation of a triac. However, the comparably low currents drawn by LEDs from efficient power supplies may not be enough compared to the minimum holding currents required to keep triac switches conducting for reliable operation. As a consequence, conventional power supply controller designs usually rely on the power supply including a dummy load, sometimes called a bleeder circuit, in addition to the LEDs to take enough extra current from the input of the power supply to keep the triac conducting reliably after it is triggered. In general, a conventional bleeder circuit is external from the integrated circuit of the conventional power supply controller. However, use of the conventional bleeder circuit external to the conventional power supply controller requires the use of extra components with associated penalties in cost and efficiency.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

As will be shown, a new feed forward circuit for an LED driver including triac dimming circuitry is disclosed. The new circuit provides improved reliable performance of an LED driver having a pre-stage triac dimming circuit. As mentioned, typical low cost triac dimming circuits often have poor performance and as a consequence provide imbalanced load currents for each line half-cycle due to the inaccurate half-line cycle conduction phases. An example feed forward circuit in accordance with the teachings of the present invention may be added as a pre-stage, or as a front stage, in a LED driver having a triac dimming circuit. In one example, the circuit improves performance of the LED driver in low or deep dimming conditions and helps prevent shimmering in an LED lamp driven by the LED driver that would otherwise result due to inaccurate conduction phase angle control and imbalanced load currents in successive line half-cycles due to the triac dimming circuit. The disclosed example circuit compensates the feedback signal in a regulated power supply of an LED driver with a feed forward signal responsive to the line conduction angle of the rectified input voltage signal in accordance with the teachings of the present invention.

In the following description numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Throughout this specification, several terms of art are used. These terms are to take on their ordinary meaning in the art from which they come, unless specifically defined herein or the context of their use would clearly suggest otherwise. For example, the term "or" is used in the inclusive sense (e.g., as in "and/or") unless the context clearly indicates otherwise.

Figure 1:
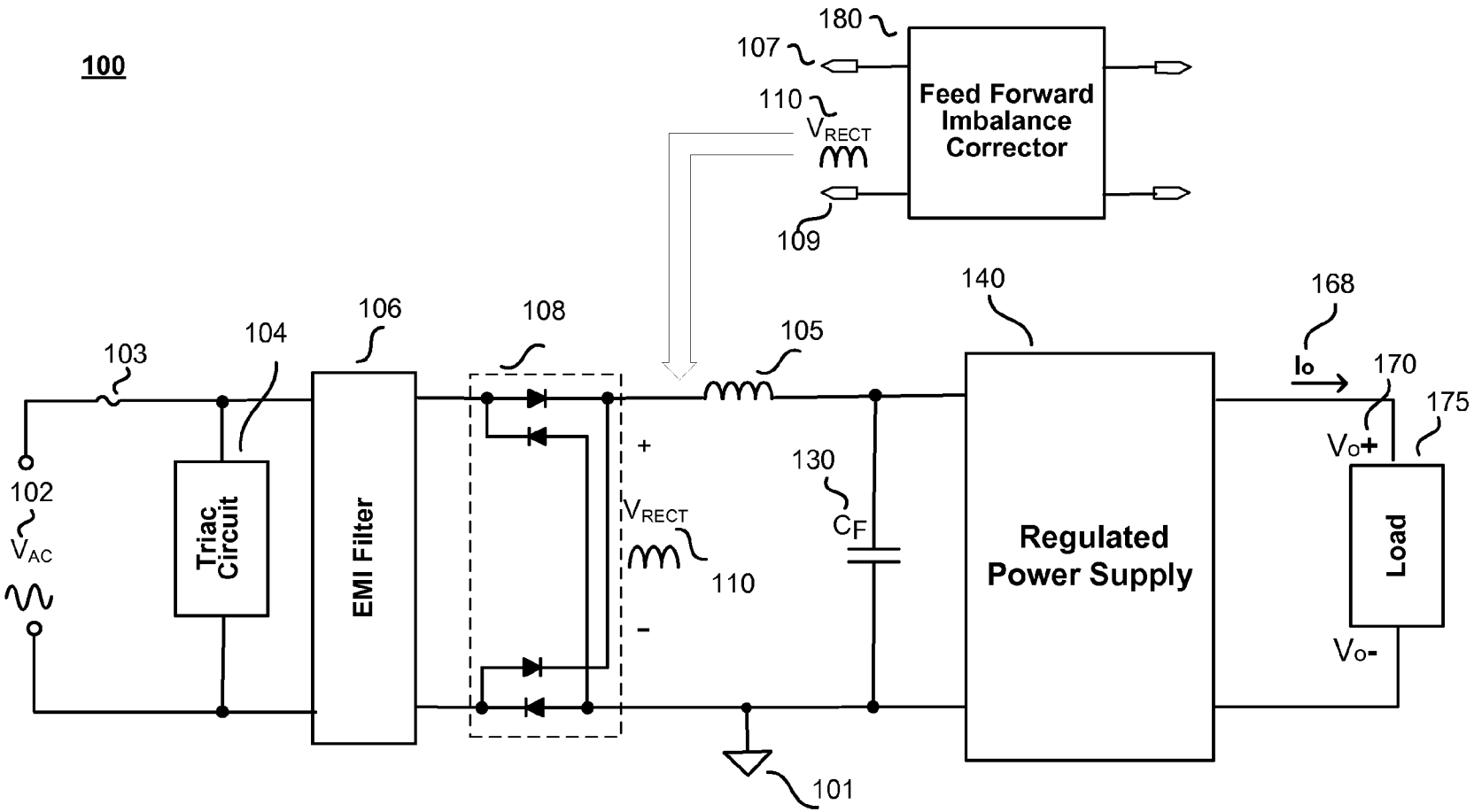
FIG. 1 is a block diagram illustrating generally one example of an LED driver including triac dimming circuitry and an example feed forward imbalance corrector in accordance with the teachings of the present invention.

To illustrate, FIG. 1 shows a general block diagram of an LED driver including a regulated power supply and a triac dimming circuit. As shown, a pre-stage triac circuit 104 is coupled to the input ac line signal Vac 102 through a fusible protection device 103 to control the conduction phase of the sinusoidal input voltage of the input ac line signal Vac 102 fed to the rectifier bridge 108 through the electromagnetic interference (EMI) filter 106. The triac circuit operates by delaying the beginning of each half-cycle of input ac line signal Vac 102, By delaying the beginning of each half-cycle of the input ac line signal vac 102 with triac circuit 104, the amount of power delivered to the lamp is reduced and the light output of the LED appears dimmed. As shown in the depicted example, the rectified voltage $V_{RECT}$ 110, having a conduction phase angle control in each half line cycle responsive to triac circuit 104, is produced by the rectifier bridge 108. As shown, the rectified voltage $V_{RECT}$ 110 provides an adjustable average dc voltage to a high frequency regulated power supply 140 through some required or optional interface devices/blocks such as inductive block 105 and capacitive filter 130 and/or other required blocks depending on the application. As illustrated, an example circuit 180, which is labeled as "Feed Forward Imbalance Corrector" in the example, is cascaded at the interface between rectifier bridge 108 and regulated power supply 140 in accordance with the teachings of the present invention. In one example, the output voltage Vo 170 and the regulated output current Io 168 are coupled to drive the load 175, which in one example could be string of one or more LEDs.

Figure 2:
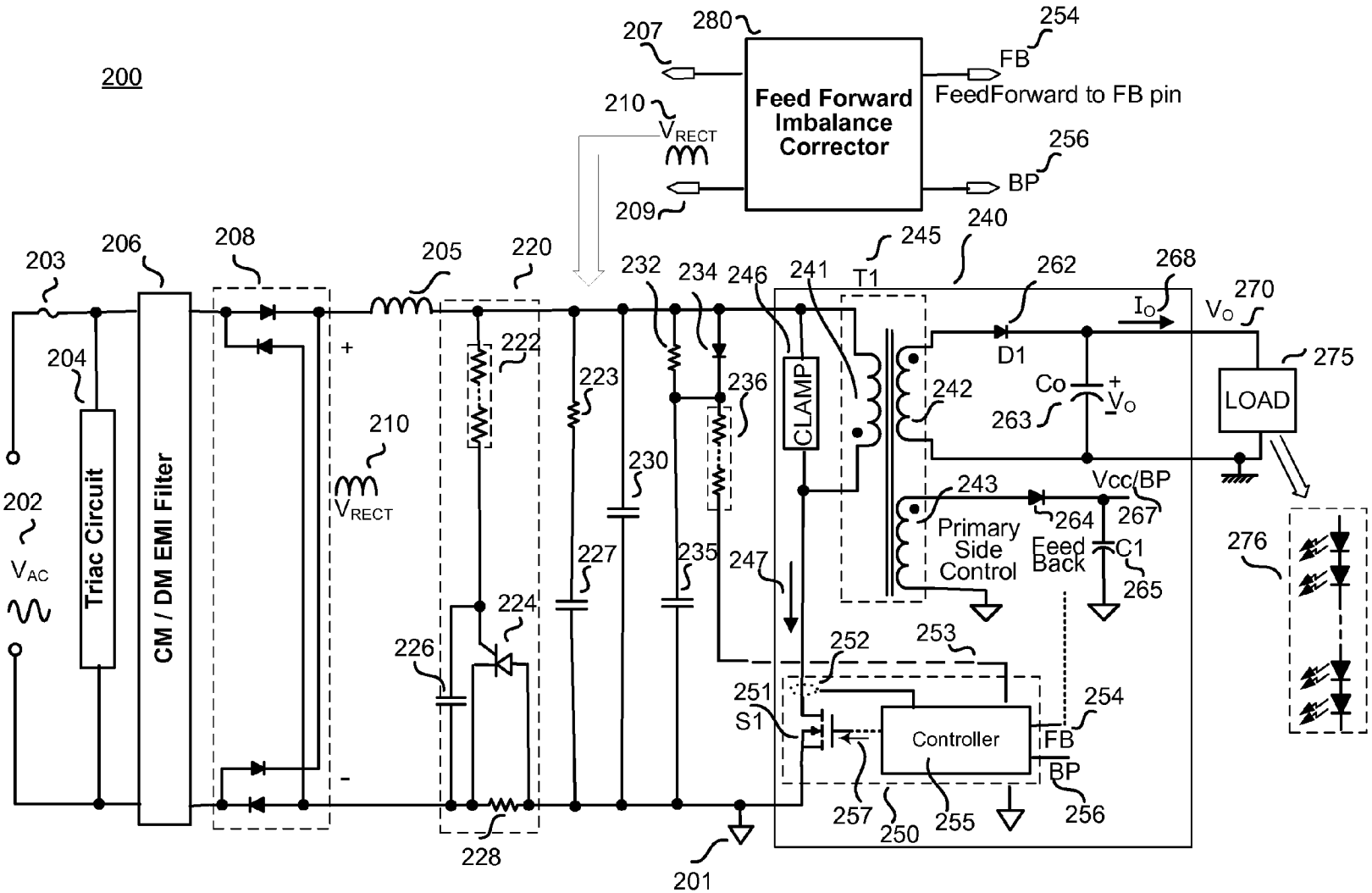
FIG. 2 is a schematic illustrating generally another example of an LED driver including triac dimming circuitry and an example feed forward imbalance corrector in accordance with the teachings of the present invention.

FIG. 2 is an example schematic shown some additional detail of an LED driver similar to that as described in FIG. 1. As shown in the illustrated example, an input ac voltage Vac 202 is coupled through a fusible protection device 203 to a pre-stage triac dimming circuit 204, followed by a common and/or differential mode EMI filter 206 and the bridge rectifier 208. An example circuit 280, which is shown in the illustration as "Feed Forward Imbalance Corrector," may be cascaded at the interface between the bridge rectifier 208 and a high frequency regulated power supply 240. In the example, bridge rectifier 208 outputs rectified voltage $V_{RECT}$ 210 between two output terminals of the bridge rectifier 208 with conduction phase angles in each half line cycle as controlled by the triac circuit 204 that adjusts the average dc voltage received by the regulated power supply 240, which results in the desired dimming. In one example, the example circuit 280 in accordance with the teachings of the present invention feeds forward a current (signal) in response to the conduction angle of triac circuit to adjust/compensate the imbalance conduction angles in line half cycles. In one example, an inductive element 205 is coupled between bridge rectifier 208 and regulated power supply 240 as shown to help prevent the impulsive current at the rising/leading edge of the triac conduction angle.

The example LED driver of FIG. 2 provides output dimming with a low cost, triac-based, leading edge phase control dimmer supply with an active damper 220, capacitance 227 and resistance 223 arranged as shown. Since the LED driver of FIG. 2 is coupled to drive a load 275, which in one example is a string of one or more LEDs 276 as shown, the current drawn by the string of LEDs 276 may be below the holding current of the triac used in the triac dimming circuit 204. As mentioned, current drawn by the string of LEDs 276 being below the holding current may cause the undesirable behavior discussed above, including a limited dimming range and/or flickering as the triac fires inconsistently as a result of the low current drawn by the string of LEDs 276. In addition, due to the inrush current charging the input capacitance 230 and because of the relatively large impedance that the string of LEDs 276 present to the line, a significant ringing may occur whenever the triac turns on in the triac dimming circuit 204. This ringing may cause even more undesirable behavior as the triac current could fall to zero and turn off the string of LEDs 276, resulting in flicker.

In the depicted example, active damper 220, passive bleeder, capacitance 227 and resistance 223 are incorporated into the LED driver of FIG. 2 to address the undesirable behavior discussed above. It is noted that the inclusion of these circuits results in increased energy dissipation and reduced efficiency when compared to a non-dimming application, in which these circuit elements are not necessary and therefore could simply be omitted. As shown in the example, active damper 220 is coupled at the input interface of the regulated power supply 240 and performs as an active damping module consisting of resistor module 222, a semiconductor-controlled rectifier (SCR) 224, capacitance 226 and resistance 228. This active damping module acts to limit the inrush current that flows to charge capacitor 230 when the triac turns on by placing resistance 228 in series for a short time of the conduction period, which in one example is the first 1 ms of conduction. This short period of time is calculated and defined by selecting values for resistor module 222 and capacitance 226. In one example, the charging time of capacitance 226 to the activation threshold of SCR 224 is responsive to the values for resistor module 222 and capacitance 226. After this short period of time, such as for example approximately 1 ms, SCR 224 turns on and shorts resistance 228. This allows a larger value damping resistance during current limiting at short interval of starting conduction while keeps the power dissipation on resistance 228 low afterwards during normal operation. In one example, SCR 224 is a low current, cost effective device. In the example, capacitance 227 and resistance 223 form a passive bleeder circuit that keeps the input current above the triac holding current while the input current corresponding to the driver increases during each ac half-cycle, which helps to prevent the triac from oscillating on and off at the start of each conduction angle period.

Continuing with the example shown in FIG. 2, the energy transfer element, transformer T1 245 has primary winding 241 coupled to the dc bus and the drain of MOSFET switch S1 251. During the on-time of switch S1 251, current ramps through the primary winding 241 storing energy which is then delivered to the output during the switch S1 251 off time. The clamp circuit 246 across primary prevents any voltage spike that may happen due to leakage inductance of winding oscillating with the existing parasitic capacitances and may damage the switch S1 451. To provide peak line voltage information to the controller 255, the incoming rectified ac peak charges capacitance 235 via diode 234. In the example, the peak line voltage information is fed as a current via resistor module 236 into the pin 253 of the controller 255, which enables controller 255 to monitor line voltage level. In the example, the current to pin 253 can also be used to set the input line over-voltage and under voltage protection thresholds. Resistor 232 provides a discharge path for capacitance 235 with a time constant much longer than that of the line rectified half-cycle to prevent any line frequency current being modulated at pin 253 of the controller 255.

In one example, the secondary winding 242 of transformer T1 245 is rectified by an ultrafast diode D1 262 and filtered by a capacitor Co 263. The output voltage Vo 270 and regulated output current To 268 feed the load 275 that in an example of LED driver application could be a string of LEDs 276. In some applications, a small pre-load (not shown) could be provided to limit the output voltage under no-load conditions.

In one example, a third winding 243 on transformer T1 245 is utilized as bias supply to generate Vcc/BP 267 through rectifier diode 264 and filter capacitance C1 265. The voltage on third winding 243 is also used to sense the output voltage indirectly and provide a feedback signal representative of the output voltage Vo 270 on FB pin 254, which may be referred to as primary side control and eliminates the secondary side control feedback components. In one example, the voltage on the third winding (bias winding) is proportional to the output voltage, as determined by the turns ratio between the bias and secondary windings. In the example, the controller 255 is included in regulated power supply 240 and is coupled to be responsive to the feedback signal received at FB pin 254, the input voltage signal on pin 253 and drain current 252 to generate a gating signal 257 on switch S1 251 to provide a regulated constant output current, which in one example may be over a 2:1 output voltage range. In other examples, the switching scheme may maintain high input power factor. In the example, controller 255 is also coupled to receive a bias supply/bypass voltage Vcc/BP 267 at the bypass BP terminal 256. In one example, controller 255 and switch S1 251 are included in a monolithic IC structure.

Figure 3:
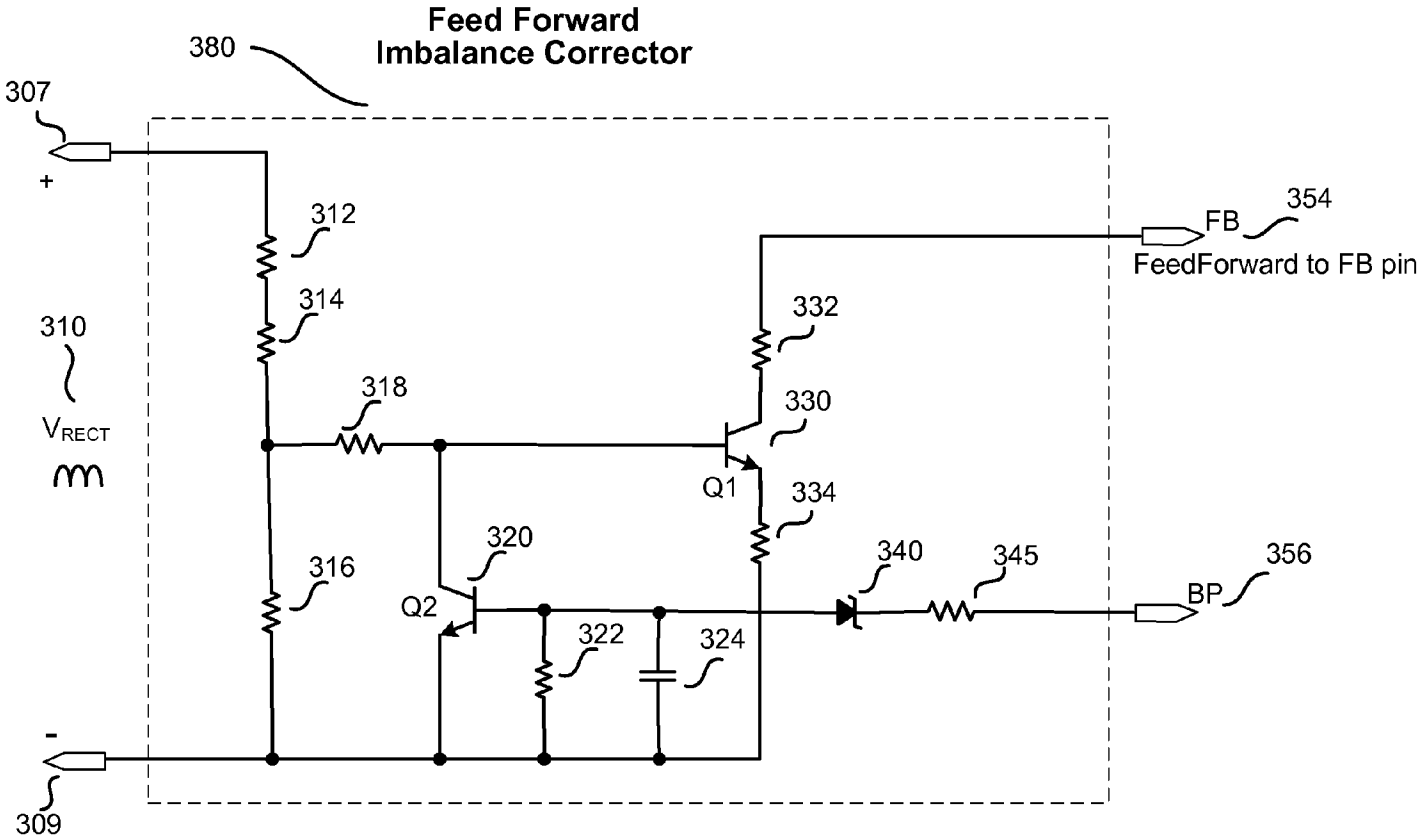
FIG. 3 is a schematic illustrating generally an example feed forward imbalance corrector in accordance with the teachings of the present invention.

FIG. 3 is an example schematic of a feed forward imbalance corrector 380, which may correspond to the internal circuitry of, for example, circuit 180 and/or 280 of FIGS. 1-2, respectively, in accordance with teachings of the present invention. In one example, the first and second input port terminals 307 and 309 are coupled to the positive and negative terminals, respectively, of the output of the rectifier bridge to receive $V_{RECT}$ 310. In one example, the first output port terminal 354 is coupled to feedback pin FB of the controller, which may correspond to FB pin 254 of controller 255 in FIG. 2. The second output port terminal 356 is coupled to bypass pin BP of the controller, which may correspond to BP pin 256 of controller 255 in FIG. 2.

As will be illustrated in further detail below, a resistive divider at input port including resistors 312, 314 and 316 provides a scaled signal representative of $V_{RECT}$ 310 to a control terminal of an active device Q1, which is illustrated in FIG. 3 as transistor Q1 330. As shown in the example illustrated in FIG. 3, the resistive divider provides a biasing current for transistor Q1 330 at leading edges of triac conduction angles of $V_{RECT}$ 310 through a resistor 318. Thus, the current conducted through transistor Q1 330 is controlled in response or is proportional to the leading edges of triac conduction angles of $V_{RECT}$ 310. As a result, the net feedback current to the feedback pin of the controller, which may correspond for example to FB pin 254 of controller 255 in FIG. 2, is adjusted or reduced in response to the resulting current passing from the collector to the emitter of transistor Q1 330 through resistors 332 and 334 to terminal 309. Thus, in the illustrated example, the net feedback current to the feedback pin of the controller is adjusted in response to current that flows through transistor Q1 330, which is controlled in response to $V_{RECT}$ 310 in accordance with the teachings of the present invention. In one example, the adjustments to the feedback current correspondingly adjust the output current of the LED driver in response to the triac conduction angles of $V_{RECT}$ 310. Since the conduction time of Q1 330 depends on the conduction angle of the rectified input voltage $V_{RECT}$ 310, the phase by phase output current imbalance at each half line cycle is corrected in accordance with the teachings of the present invention.

In one example, transistor Q1 330 can also be controlled or deactivated through an active device Q2, which is illustrated in FIG. 3 as transistor Q2 320. In the example, transistor Q1 330 can also be controlled or deactivated by shorting the control terminal or base of transistor Q1 330 to the return terminal 309 through transistor Q2 320 whenever voltage on bypass pin BP 356 exceeds the predetermined rated breakdown level of zener diode 340. A bias current for transistor Q2 320 is provided from BP pin 356 through resistor 345 and zener diode 340 to turn off transistor Q2 320. Thus, feed forward imbalance corrector 380 will be activated when the voltage on BP pin 356 is lower than the predetermined rated level of zener diode 340 in accordance with the teachings of the present invention.

In the example, resistance 322 and capacitance 324 provide an RC filter, which is coupled to transistor Q2 320, bypass pin BP 356 and terminal 309 as shown to help prevent unwanted biasing of transistor Q2 320, which would deactivate transistor Q1 330 and cancel the desired effect of feed forward imbalance correction in accordance with the teachings of the present invention.

Figure 4:
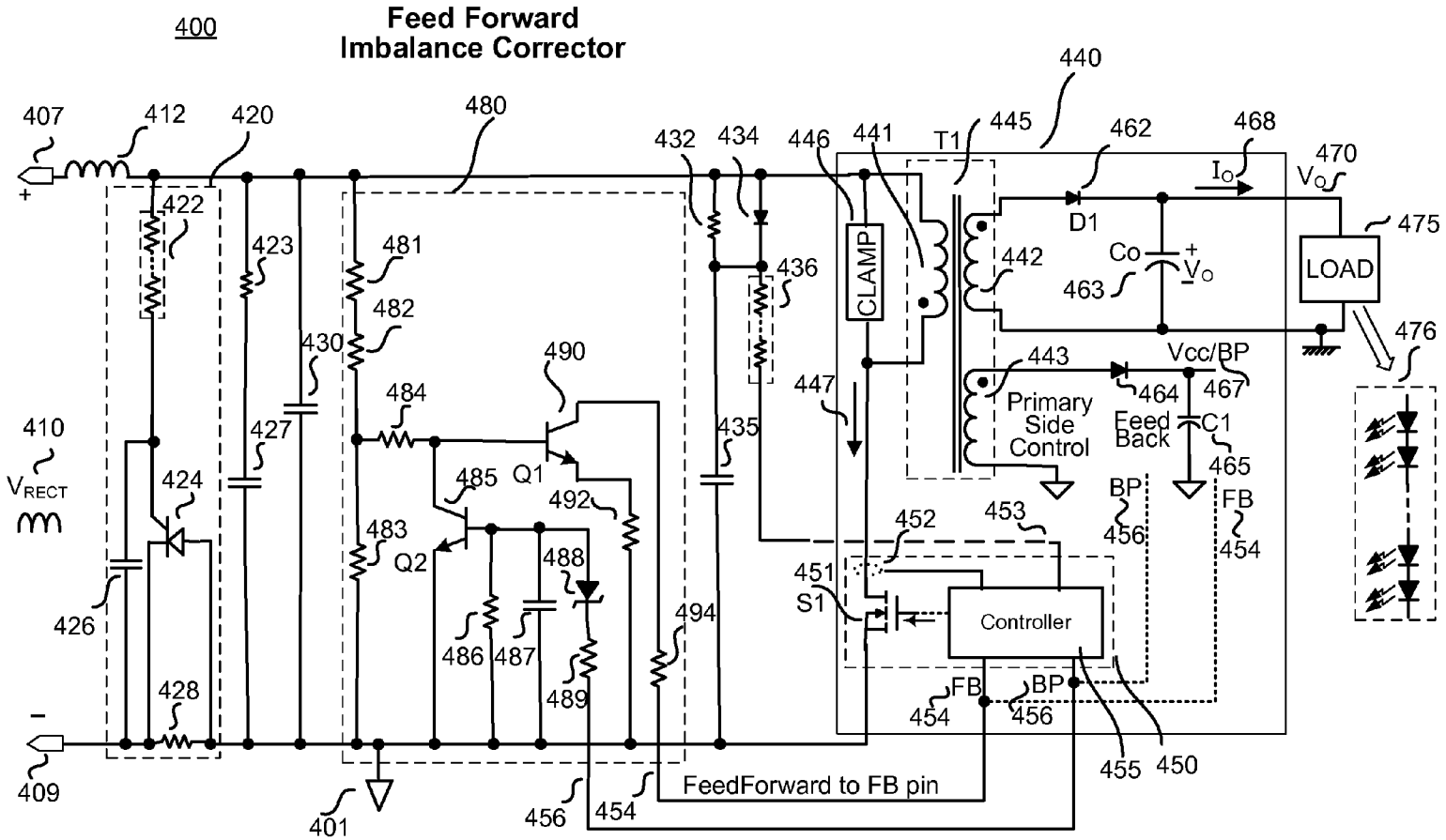
FIG. 4 is a schematic illustrating generally yet another example of an LED driver including triac dimming circuitry and an example feed forward imbalance corrector in accordance with the teachings of the present invention.

FIG. 4 shows another example schematic of an LED driver that includes an example circuit, as described in FIGS. 1-3 above, as a part of an LED driver in accordance with the teachings of the present invention. As shown, the input port terminals 407 and 409 are coupled to receive the rectified voltage $V_{RECT}$ 410, such as for example $V_{RECT}$ 210 provided at the output of bridge rectifier 208 in FIG. 2. In one example, the input circuitry is similar to that as described above in FIG. 2. Inductance 412 prevents the impulsive current at the rising/leading edge of the triac conduction angle.

As shown in the example, an active damper 420 at the input interface, which includes resistance 422, SCR 424, capacitance 426 and resistance 428, is utilized as an active damper that limits the inrush current of charging capacitor 430 whenever the triac turns on, similar to for example active damper 220 of FIG. 2.

In operation, at each conduction period of the triac, for a short time defined by charging time of capacitance 426 through resistance 422 to the threshold activation voltage of SCR 424, the resistance 228 is placed in series to the inrush current of charging capacitor 430. This short period of time in one example is the first 1 ms of triac conduction. After this short period of time that capacitance 426 is charged through resistance 422 to the threshold activation voltage of SCR 424, the resistance 428 gets shorted by SCR 424 to prevent extra loss and efficiency reduction during normal operation.

Similar to the counterpart components described in FIG. 2, the capacitance 427 and resistance 423 form a passive bleeder circuit, which helps to keep the input current above the triac holding current during each ac half-cycle while the input current corresponding to the driver increases. This also helps to prevent the triac from oscillating on and off at the start of each conduction angle period.

As shown, the circuit 480, labeled in the example as "feed forward imbalance corrector," is cascaded at the input interface of the high frequency regulated power supply 440 of the LED driver. In the example, circuit 480 includes similar counterpart components to those discussed above with respect to FIG. 3. At input port terminals 407 and 409, a resistive divider, which includes resistances 481, 482 and 483, provides a scaled signal representative of $V_{RECT}$ 410 to a control terminal of an active device Q1, which is illustrated in FIG. 4 as transistor Q1 490. As shown in the example illustrated in FIG. 4, the restive divider provides a bias current through resistance 484 for transistor Q1 490 at the leading edges of the triac conduction angles in the rectified voltage $V_{RECT}$ 410. Thus, the current conducted through transistor Q1 490 is controlled in response or is proportional to $V_{RECT}$ 410. As a result, the net feedback current to FB pin 454 of controller 455 is adjusted or reduced by the amount of current passing from the collector to the emitter of transistor Q1 490 through resistors 494 and 492. In operation, the reduced feedback current to FB pin 454 of controller 455 lowers the output current Io 468 in response to the triac conduction angles in the rectified voltage $V_{RECT}$ 410 in accordance with the teachings of the present invention. Since the conduction time of Q1 490 is responsive to the conduction angles of the rectified input voltage $V_{RECT}$ 410, the phase by phase output current imbalance at each half line cycle is corrected in accordance with the teachings of the present invention.

An active device Q2, which is illustrated in FIG. 4 as transistor Q2 485 deactivates the transistor Q1 490 of the feed forward imbalance corrector circuit 480 by shorting the control terminal or base of transistor Q1 490 to the return terminal 409 whenever the voltage on bypass pin BP 456 exceeds the predetermined/rated breakdown level of zener diode 488. The bias current to turn on transistor Q2 485 is provided through zener diode 488 from BP pin 456 through resistor 489. Thus, in one example, the circuit 480 is activated only when the voltage on BP pin 456 is lower than the predetermined rated level of zener 488 in accordance with the teachings of the present invention.

Resistance 486 and capacitance 487 at the gate of transistor Q2 485 provide an RC filter, which filters out noise and helps to prevent unwanted biasing of transistor Q2 485, which would deactivate transistor Q1 490 and cancel the desired effect of feed forward imbalance correction in accordance with the teachings of the present invention.

As shown, the output ports 456 and 454 of circuit block 480 are coupled to the BP pin 456 and FB pin 454 of the controller 455, respectively, which in one example may be monolithically included in an integrated circuit 450 with the MOSFET power switch S1 451.

In the depicted example, a transformer T1 445 having a primary winding 441 is coupled to receive the rectified dc voltage $V_{RECT}$ 410 and the drain of switch S1 451. A clamp circuit 446 is coupled across primary winding 441 as shown to help prevent voltage spikes due to leakage inductance of the winding oscillating with the existing parasitic capacitances that otherwise may damage the switch S1 451. During the on-time of switch S1 451, energy is stored as current ramps through the primary winding 441. During the off time of switch S1 451, energy is delivered to the output.

In the example, capacitance 435 via diode 434 is charged by the rectified ac peak to provide information of peak line voltage to the controller 455 as a current fed via resistor module 436 into the pin 453 of the controller 455 to monitor line voltage level. In one example, the current to pin 453 can also be utilized to set over-voltage and under voltage protection thresholds of the input line. Resistor 432 provides a discharge path for capacitance 435 with a long time constant that may not modulate any line frequency current at pin 453 of the controller 455.

In the example, the secondary winding 442 of transformer T1 445 is rectified by ultrafast diode D1 462 and filtered by capacitor Co 463. The output voltage Vo 470 and regulated output current Io, 468 feed the load 475, which in an example could be a string of one or more LEDs 476. In some applications a small pre-load (not shown) could be provided to limit the output voltage under no-load conditions.

In the depicted example, primary side control is provided by utilizing a third winding 443 of transformer T1 445 to sense the output voltage indirectly and provide a feedback signal representative of output voltage Vo 470 on FB pin 454, which is referenced to the primary side ground 401 and eliminates the need for secondary side control feedback components. The voltage on the third winding 443 (bias winding) is proportional to the output voltage, as determined by the turns ratio between the bias and secondary windings. In one example, the voltage on third winding 443 is also used as the bias supply to generate bypass voltage Vcc/BP 467 through rectifier diode 464 and filter capacitance C1 465, and is coupled to the bypass terminal BP 456 of controller 455.

In one example, the internal circuitry of controller 455 may combine the signals or information from FB pin 454, the input voltage signal on pin 453 and drain current 452 to generate a gating signal 456 on switch S1 451 to provide a regulated constant output current, which in one example may be over a 2:1 output voltage range. In other examples, the switching scheme may also maintain a high input power factor. In one example controller 455 and the switch S1 451 could be included in a monolithic IC structure 450.

Figure 5A:
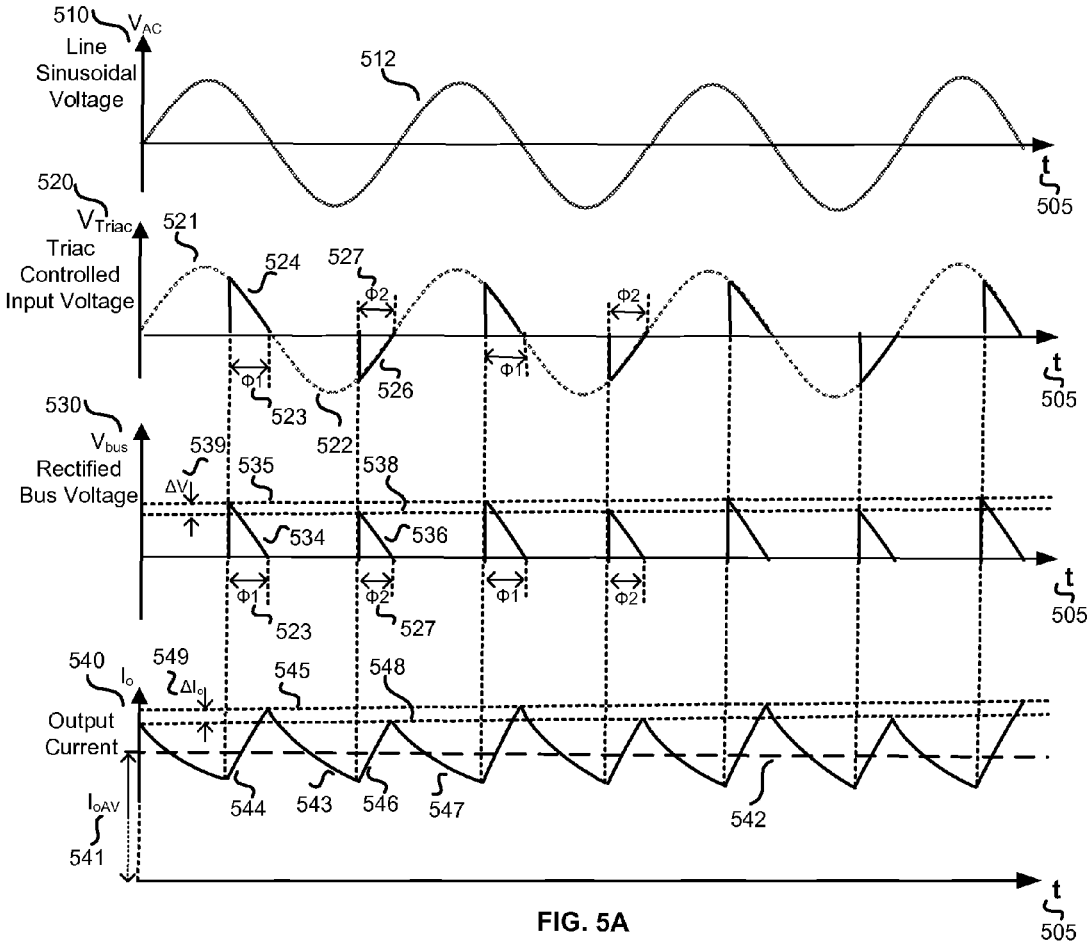
FIG. 5A shows example timing diagrams illustrating some general waveforms at different locations in an LED driver having imbalanced triac controlled dimming circuitry.

FIG. 5A shows example timing diagrams illustrating some general waveforms at different locations in an LED driver having imbalanced triac controlled dimming circuitry. In the depicted examples, the horizontal axis on all the waveforms includes several line frequency cycles over time t 505. As shown, timing diagram 510 illustrates an input line ac full sinusoidal waveform 512 versus time t 505. Timing diagram 520 illustrates the waveform of a triac controlled ac input voltage with the dotted portion 522 not being conducted through the triac. In particular, only the conduction angle Φ1 523 during the positive line half-cycle depicted by the solid line 524 and the conduction angle Φ2 527 during negative line half-cycle depicted by the solid line 526 are applied at the input of the dimming LED driver to the bridge rectifier. Thus, there is a reduced average voltage applied to the input of LED driver to produce a desired level of dimming at the output. However, as mentioned previously, in typical low cost triac dimmers, it is not unusual for there to be some unwanted variations between the conduction angles of the positive and negative line half-cycles 524 and 526, which consequently result in unequal phase by phase conduction angles causing $\Phi 1 \neq \Phi 2$. For instance, in the example timing diagram 520 illustrated in FIG. 5A, $\Phi 1 > \Phi 2$.

Timing diagram 530 shows the rectified bus voltage at output of bridge rectifier, corresponding to, for example, $V_{RECT}$ 110, 210, 310 and/or 410 in FIGS. 1-4, respectively. It is noted that the leading edges of conduction angle Φ1 523 and conduction angle Φ2 527 in the rectified bus voltage provide the biasing current for transistor Q1 330 and/or Q1 490 as mentioned above in connection with FIGS. 3-4, respectively.

Referring back to FIG. 5A, timing diagram 530 depicts the conduction period at the positive line half-cycle 534 and at the negative line half-cycle 536 and the difference ΔV 539 between the peak voltage points of positive and negative line half-cycles 534 and 536 during dimming. As shown in the example, the peak voltage points of the positive line half-cycles 534 reach a level 535 and the peak voltage points of the negative line half-cycles 536 reach a level 538. Due to the larger conduction angle Φ1 523 of the positive line half-cycles 534 compared to the smaller conduction angle Φ2 527 of the negative line half-cycles 536, level 535 is greater than level 538. As a result, there are differences in the load current crest values for the positive and negative line half-cycles 534 and 536. Consequently, there is an uneven ripple at the line frequency in the output load current, which may cause undesirable LED light shimmering.

In the example shown on FIG. 5A, timing diagram 540 shows the regulated output current Io of the LED load. As shown, during the positive line half-cycles that correspond to the larger conduction angle Φ1 523, the current ripple 544 rises to a crest value of 545, which is higher than the crest value of 548 reached by current ripple 546 during the negative line half-cycles that correspond to the smaller conduction angle Φ2 527. During the non-conducting intervals of triac, which are illustrated as dotted intervals 521 and 522 in FIG. 5A, the ripple current drops low as indicated with current ripple 543 and current ripple 547. Although the average current line 542 is defined the average load current value IoAV 541, the difference ΔIo 549 between ripple current crest values 545 and 548 of the positive and negative line half-cycles causes shimmering in the LED light.

Figure 5B:
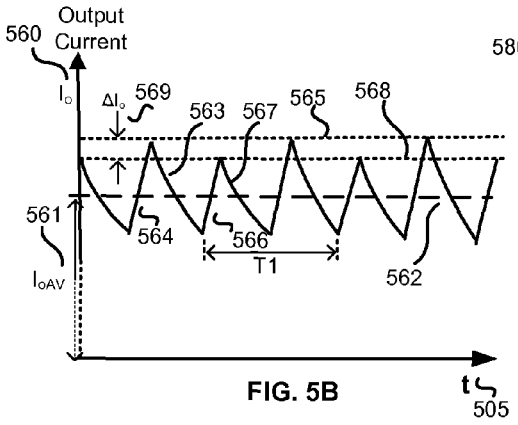
FIG. 5B illustrates an example current waveform in an LED driver having triac dimming circuitry without an example feed forward imbalance corrector in accordance with the teachings of the present invention.
Figure 5C:
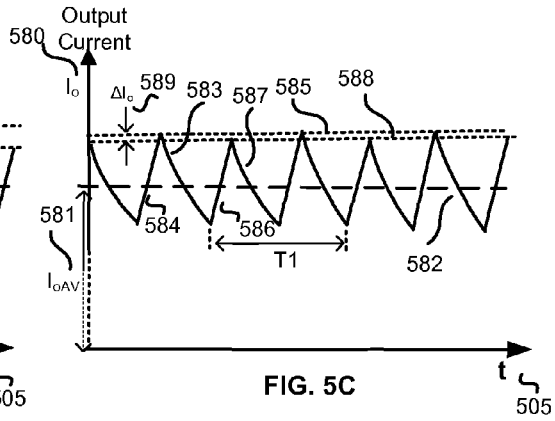
FIG. 5C illustrates an example current waveform in an LED driver having triac dimming circuitry including an example a feed forward imbalance corrector in accordance with the teachings of the present invention.

FIGS. 5B and 5C illustrate a side by side comparison of example load current waveforms under the same conditions of an LED driver and load. In particular, FIG. 5B illustrates an example current waveform in an LED driver having triac dimming circuitry without an example a feed forward imbalance corrector, while FIG. 5C illustrates an example current waveform in an LED driver having triac dimming circuitry with an example a feed forward imbalance corrector in accordance with the teachings of the present invention.

In particular, in the example depicted in FIG. 5B, the vertical axis represents the load/output current Io 560 in an LED driver that does not include a feed forward imbalance corrector circuit as described in FIGS. 1-4, while the horizontal axis represents time t 505. During a positive line half-cycle with a bigger conduction angle Φ1 523, the current ripple 564 rises to a higher crest value of 565 while during a negative line half-cycle with a smaller conduction angle Φ2 527, the current ripple 566 rises to a lower crest value of 568, which results in a line frequency fluctuation in output current ΔIo 569 that affects the LED output light causing the undesired effect of shimmering.

In comparison, in the example depicted in FIG. 5C, the vertical axis represents the load/output current Io 580 in an LED driver that includes a feed forward imbalance corrector circuit, such as those described above in FIGS. 1-4, while the horizontal axis represents time t 505. In the example depicted in FIG. 5C, the output load current Io 580 versus time 505 waveform is illustrated under the same conditions of supply and load as illustrated in FIG. 5B. As shown, the average of the higher and lower crest values 585 and 588 of FIG. 5C are the same as the average of the higher and lower crest values 565 and 568 of FIG. 5B. In addition, the average load current IoAV 581 of FIG. 5C is the same as the average load current IoAV 561 of FIG. 5B. Indeed, as a result of the current adjustment/compensation effect on the feedback pin current provided in FIG. 5C by a feed forward imbalance corrector circuit, such as for example feed forward imbalance corrector circuit 180, 280, 380 and/or 480 of FIGS. 1-4, respectively, the rising slopes of the current ripples 584 and 586 result in a lower output current difference ΔIo 589 in FIG. 5C compared to output current difference ΔIo 569 in FIG. 5B. Therefore, FIG. 5C illustrates the improved output current with less shimmering in an LED driver that includes a feed forward imbalance corrector circuit in accordance with the teachings of the present invention.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. A circuit, comprising:

a first active device coupled between a third terminal and a second terminal, the first active device having a control terminal coupled to a first terminal to receive a signal representative of a rectified input voltage; and a second active device coupled between the control terminal of the first active device and the second terminal, the second active device having a control terminal coupled to a fourth terminal, wherein the second active device is coupled to be controlled in response to a bypass voltage at the fourth terminal and wherein a current conducted through the first active device is controlled in response to the rectified input voltage and the bypass voltage.

2. The circuit of claim 1 further comprising a resistive divider coupled between the first terminal and the second terminal, wherein the control terminal of the first active device is coupled to the resistive divider to receive the signal representative of the rectified input voltage through the resistive divider.

3. The circuit of claim 2 further comprising a resistance coupled between the control terminal of the first active device and the resistive divider.

4. The circuit of claim 1 further comprising a zener diode coupled between the control terminal of the second active device and the fourth terminal.

5. The circuit of claim 1 further comprising a filter coupled to the second active device, the fourth terminal and the second terminal.

6. The circuit of claim 1 wherein the third terminal is coupled to a feedback terminal of a controller of a regulated power supply, wherein a net feedback current to the feedback terminal of the controller is adjusted in response to the current conducted through the first active device.

7. The circuit of claim 1 wherein the fourth terminal is coupled to a bypass terminal of a controller of a regulated power supply, wherein the second active device is coupled to deactivate the first active device in response to a bypass voltage at the bypass terminal of the controller.

8. The circuit of claim 1 wherein the rectified input voltage is coupled to be received from a bridge rectifier coupled to a triac circuit of a light emitting diode (LED) driver.

9. The circuit of claim 8 wherein the signal representative of the rectified input voltage is coupled to provide a biasing current to the control terminal of the first active device at leading edges of triac conduction angles of the rectified input voltage.

10. The circuit of claim 1 wherein the first and second active devices comprise first and second transistors, respectively.

11. An light emitting diode (LED) driver, comprising:

a triac circuit coupled to receive an ac input voltage;

a rectifier coupled to the triac circuit, the rectifier to generate a rectified input voltage between first and second terminals, wherein the rectified input voltage is responsive to the ac input voltage and the triac circuit;

a regulated power supply coupled to the first and second terminals receive the rectified input voltage at an input of the regulated power supply, the regulated power supply coupled to drive an LED at an output of the regulated power supply;

a first active device coupled between a third terminal and the second terminal, the first active device having a control terminal coupled to the first terminal to receive a signal representative of the rectified input voltage; and a second active device coupled between the control terminal of the first active device and the second terminal, the second active device having a control terminal coupled to a fourth terminal, wherein the second active device is coupled to be controlled in response to a bypass voltage at the fourth terminal and wherein a current conducted through the first active device is controlled in response to the rectified input voltage and the bypass voltage.

12. The LED driver of claim 11 further comprising a resistive divider coupled between the first and second terminals, wherein the control terminal of the first active device is coupled to the resistive divider to receive the signal representative of the rectified input voltage through the resistive divider.

13. The LED driver of claim 11 wherein the regulated power supply includes a controller having a feedback terminal and a bypass terminal, wherein the feedback terminal of the controller is coupled to receive a feedback signal representative of an output voltage of the regulated power supply, wherein the bypass terminal of the controller is coupled to a bias supply of the controller.

14. The LED driver of claim 13 wherein the third terminal is coupled to the feedback terminal of the controller and wherein the fourth terminal is coupled to the bypass terminal of the controller.

15. The LED driver of claim 13 wherein a net feedback current provided by the feedback signal to the feedback terminal of the controller is adjusted in response to of the current conducted through the first active device.

16. The LED driver of claim 13 wherein the second active device is coupled to deactivate the first active device in response to a bypass voltage at the bypass terminal of the controller.

17. The LED driver of claim 11 further comprising a zener diode coupled between the control terminal of the second active device and the fourth terminal.

18. The LED driver of claim 11 further comprising a filter coupled to the second active device, the fourth terminal and the second terminal.

19. The LED driver of claim 11 wherein the signal representative of the rectified input voltage is coupled to provide a biasing current to the control terminal of the first active device at leading edges of triac conduction angles of the rectified input voltage.

20. The LED driver of claim 11 wherein the first and second active devices comprise first and second transistors, respectively.

21. A method of driving a light emitting diode (LED), comprising:

delaying a beginning of each half-cycle of an input ac line signal;

rectifying the input ac line signal to generate a rectified input voltage;

receiving the rectified input voltage at an input of a regulated power supply to drive an LED coupled to an output of the regulated power supply, wherein the regulated power supply is coupled to drive the LED coupled to the output of the regulated power supply in response to a feedback current representative of the output of the regulated power supply;

adjusting the feedback current in response to the rectified input voltage; and deactivating the adjusting of the feedback current in response to a bypass voltage received by the regulated power supply.

22. The method of claim 21 wherein adjusting the feedback current in response to the rectified input voltage comprises adjusting the feedback current in response to leading edges of conduction angles of the rectified input voltage.

23. The method of claim 21 wherein the adjusting of the feedback current comprises reducing the feedback current in response to the leading edges of conduction angles of the rectified input voltage.

24. The method of claim 21 wherein deactivating the adjusting of the feedback current comprises deactivating the adjusting of the feedback current in response to the bypass voltage exceeding a predetermined level.

25. The method of claim 21 further comprising scaling the rectified input voltage to generate a scaled signal representative of the rectified input voltage, wherein the feedback current is adjusted in response to the scaled signal representative of the rectified input voltage.

* * * * *